US006485578B1

(12) United States Patent
Park et al.

(10) Patent No.: US 6,485,578 B1
(45) **Date of Patent: *Nov. 26, 2002**

(54) CHEMICAL CLEANING PROCESS FOR REMOVING FOULING

(75) Inventors: Sam-Ryong Park, Ulsan (KR); Young-Kyoung Ahn, Koyang (KR); Sung-Gu Oh, Ulsan (KR); Ki-Hyun Lee, Ulsan (KR); Sung-Joong Kim, Seoul (KR)

(73) Assignee: SK Corporation, Seoul (KR)

( * ) Notice: Subject to any disclaimer, the term of this patent is extended or adjusted under 35 U.S.C. 154(b) by 165 days.

This patent is subject to a terminal disclaimer.

(21) Appl. No.: 09/610,730

(22) Filed: Jul. 6, 2000

(30) Foreign Application Priority Data

Mar. 20, 2000 (KR) ..... 2000-14077

(51) Int. Cl.[7] ..... B08B 7/04

(52) U.S. Cl. ..... 134/18; 134/22.1; 134/22.11; 134/22.14; 134/34; 134/35; 134/39; 134/40; 510/188; 510/195

(58) Field of Search ..... 134/18, 22.1, 22.11, 134/22.12, 22.14, 34, 35, 39, 40; 510/188, 195

(56) References Cited

U.S. PATENT DOCUMENTS 3,522,093 A * 7/1970 Woolman ..... 134/2
3,667,487 A 6/1972 Schoenbeck et al. ..... 134/108
4,773,357 A 9/1988 Scharton et al. ..... 122/382
5,006,304 A 4/1991 Franklin et al. ..... 376/316
5,085,710 A 2/1992 Goss ..... 134/22.14
5,601,657 A 2/1997 Baum ..... 134/3
5,841,826 A 11/1998 Rootham et al. ..... 376/316
6,273,102 B1 * 8/2001 Kawakami et al. ..... 134/22.1
6,283,133 B1 * 9/2001 Furuta et al. ..... 134/22.1

FOREIGN PATENT DOCUMENTS

JP 6-126262 5/1994
JP 10260135 * 9/1998 ..... G01N/21/35
JP 10-316997 12/1998

* cited by examiner

*Primary Examiner*—Randy Gulakowski
*Assistant Examiner*—M. Kornakov
(74) *Attorney, Agent, or Firm*—Drinker Biddle & Reath LLP

(57) ABSTRACT

Disclosed is a chemical cleaning process for removing fouling from process lines of oil refining or petrochemical plants. The process lines are in an on-line state and a chemical cleaning agent is circulated through the process lines to remove the fouling. It can effectively recover the thermal efficiency in oil refining processes or petrochemical processes within a short period of time, so that significant energy consumption is reduced. Furthermore, the chemical cleaning process requires a shorter cleaning period and therefore allows for a longer operating time. It can also dislodge fouling without opening heat exchangers or other equipment thereby preventing the release of VOCs. As a result, environmental pollution is not generated. The present invention is also ecconomically favorable as it extends the time between periodic maintenance.

6 Claims, 5 Drawing Sheets

CHEMICAL CLEANING PROCESS FOR REMOVING FOULING

BACKGROUND OF THE INVENTION

1. Field of the Invention

The present invention relates to a chemical cleaning process for removing fouling. More particularly, the present invention relates to the use of a chemical cleaning agent to remove fouling formed within the process lines of oil refining or petrochemical plants. The chemical cleaning agent of the present invention can be applied during periodic maintenance as well as during operation. If the cleaning agent is applied during operation, the lines are to be in an on-line state with a feed-cut condition.

2. Description of the Prior Art

Fouling is one of the most problematic obstacles to the effective operation of oil-refining plants or petrochemical plants because it reduces the efficiency of heat exchangers, causes a large loss of energy, and its removal necessitates frequent periodic maintenance. Typically, fouling results from crude petroleum deposits, such as sand, silt, clay, heavy hydrocarbons, and asphaltene or from corrosion materials such as FeS.

In order to remove fouling, various cleaning methods have been developed. One method is disclosed by U.S. Pat. No. 5,841,826 in which an aqueous chemical cleaning solution is introduced into the tubes of heat exchangers and shock waves are generated to remove sludge, scale and other deposits fouling the heat exchangers. However, the disadvantage of this method is that the cleaning has to be performed on individual heat exchangers during periodic maintenance. Another cleaning method employs a second heat exchanger which functions as a bypass during cleaning of a troubled, primary heat exchanger. The disadvantage of cleaning methods using a second heat exchanger, is that such methods require a high initial investment for installation of the second heat exchanger. Still other cleaning methods are known, including those using chemical antifoulants or turbulence promoters to remove fouling. Importantly, the previously available chemical antifoulants are generally not desirable as the benefit of their cleaning effects are outweighed by their cost. Furthermore, turbulence promoters cost a significant amount of money, and if not applied to every heat exchanger fail to bring about a very large effect in the reduction of fouling.

Mechanical cleaning methods are disclosed in U.S. Pat. Nos. 4,773,357 and 5,006,304. According to these references, fouling can be removed by the application of a high velocity water jet to heat exchangers only after the operation of the oil refining plant has been halted and the heat exchangers have been opened. The disadvantage of this method is that it forces plant managers to submit to serious financial and production losses when operation of the plant is halted to clean the heat exchanger. Additionally, the cleaning method itself is costly and results in the release of environmental pollutants such as volatile organic compounds (VOCs) from the open heat exchangers.

SUMMARY OF THE INVENTION

Chemical cleaning agents, such as non-aqueous cleaning agents comprising C8, C9 and C10 aromatic compounds, and light gas oil (LGO) or light cycle oil (LCO), and cleaning methods are disclosed which overcome conventional problems resulting from stoppage of oil refining or petrochemical processes and the opening of heat exchangers. These chemical cleaning agents effectively remove the fouling formed in process lines, including the feed line and the side stream—both of which may be feed-cut in an on-line state. Removal of fouling is monitored with a near-infra red or IR analyzer.

It is an object of the present invention to overcome conventional problems encountered in the prior art and to provide a chemical cleaning method for removing fouling from the lines of oil refining plants and petrochemical plants such that the cleaning method restores heat exchanger efficiency to start of run (SOR) levels.

Based on the present invention, the above object can be accomplished by providing a chemical cleaning method for removing fouling from process lines of oil refining or petrochemical plants, in which the process lines are in an on-line state and a chemical cleaning agent is circulated through the process lines to remove the fouling.

BRIEF DESCRIPTION OF THE DRAWINGS

The objects, features and other advantages of the present invention will be more clearly understood from the following detailed description and the accompanying drawings, in which.

DETAILED DESCRIPTION OF THE INVENTION

Figure 1:
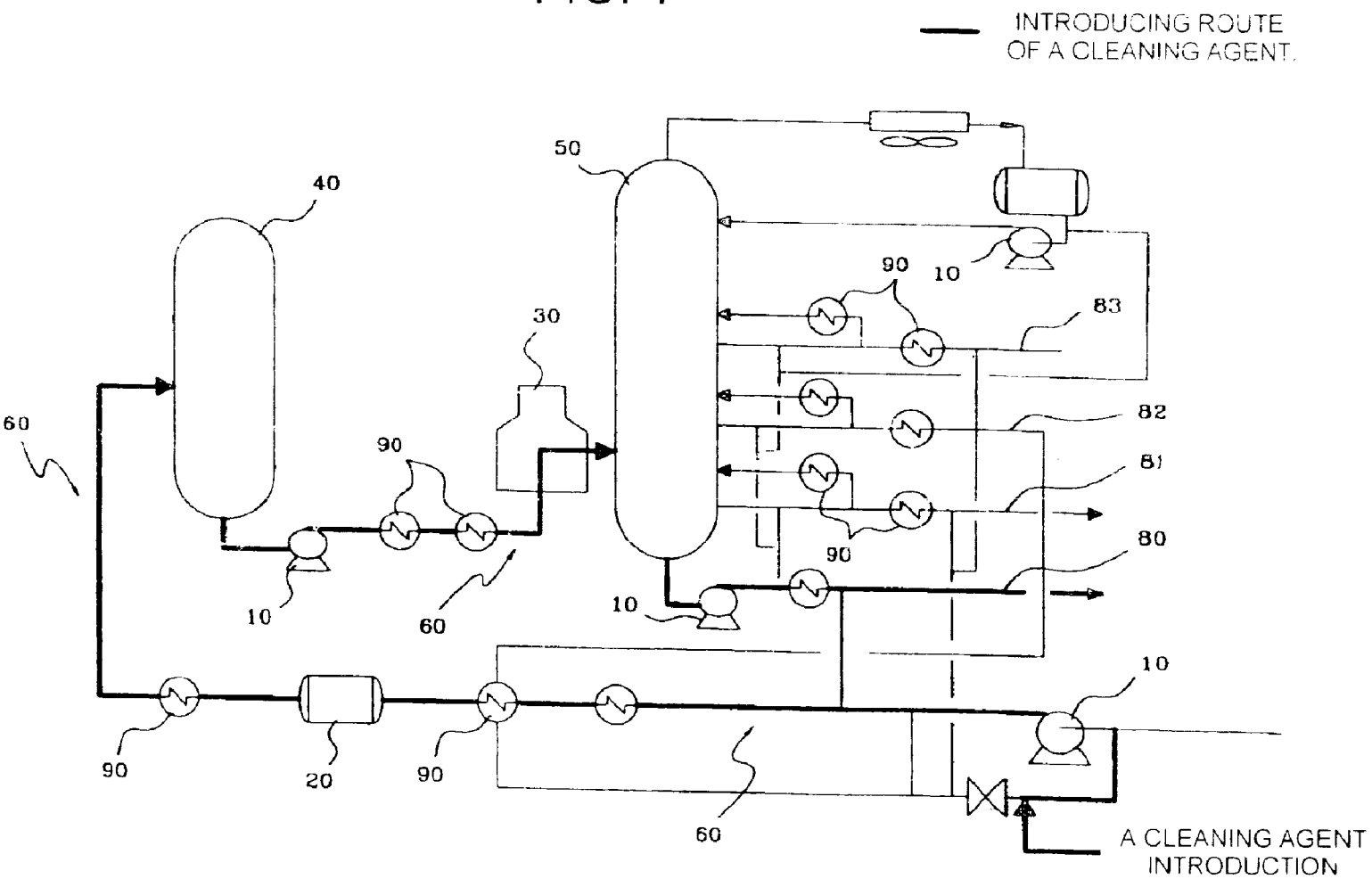
FIG. 1 is a schematic view showing introduction of a cleaning agent in accordance with the chemical cleaning method of the present invention.

As mentioned above, the cleaning process according to the present invention, can be applied under the feed-cut state during operation—as well as upon periodic maintenance. In addition, the cleaning process permits feed lines and side streams to be in an on-line state and to be cleaned with a cleaning agent at the same time.

Without cessation of the process operation, the cleaning agent is introduced into the feed-cut process lines of oil refining plants or petrochemical plants and then circulated in the process lines with the aid of a pump. For an oil refining plant, a main stream comprising a crude and a residue crude (RC, bunker-C oil) line and a side stream comprising a kerosene, a diesel and a heavy gas oil (HGO) line are connected in an on-line state so that the lines can be cleaned together with maximal efficiency. Accordingly, the method of the present invention can greatly reduce the time period during which the oil refining process is stopped. In the present invention, the connection of the main stream and the side stream in the on-line state may vary.

The application of the preferred embodiments of the present invention is best understood with reference to the accompanying drawings, wherein like reference numerals are used for like and corresponding parts, respectively.

Figure 2:
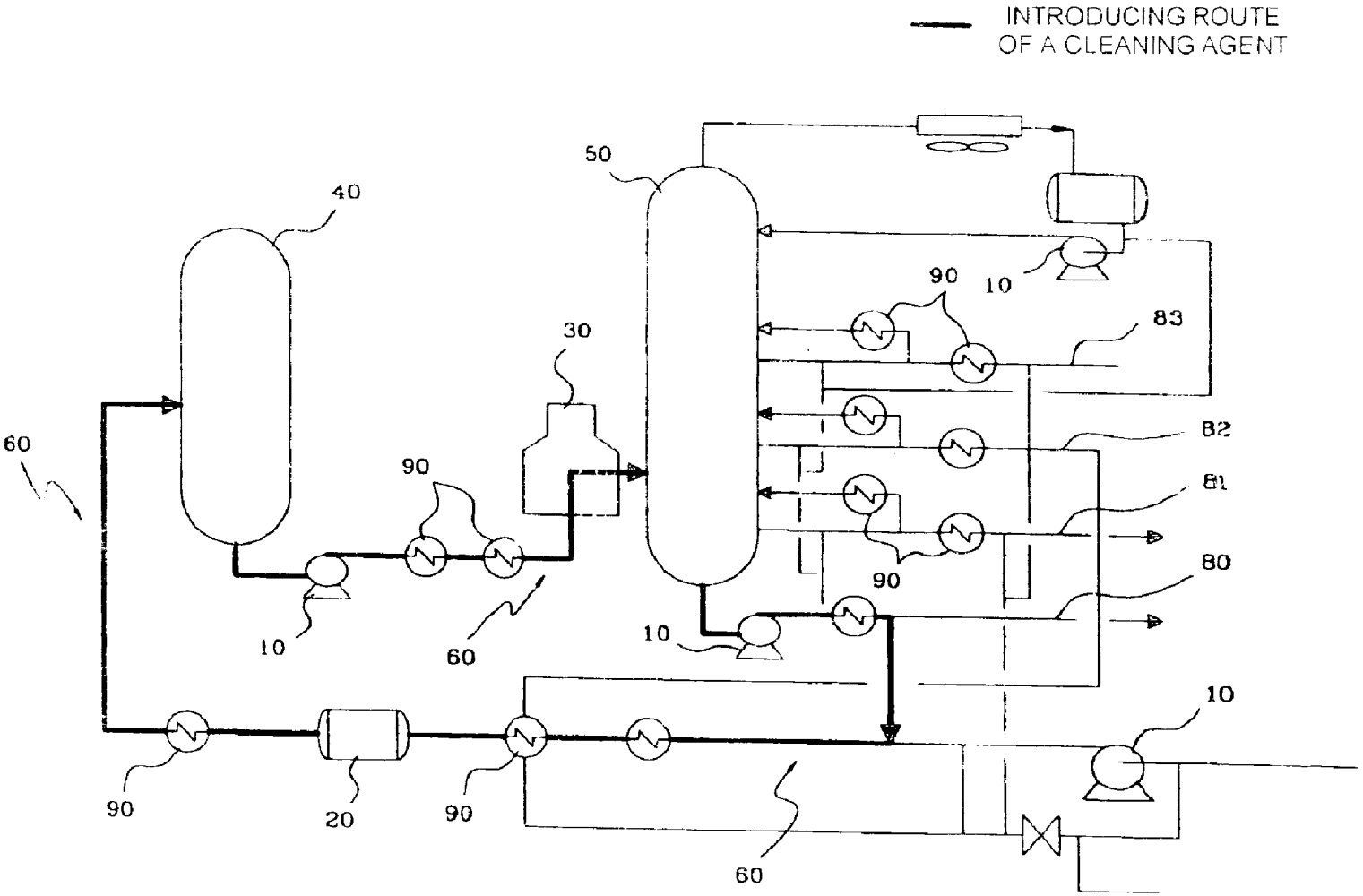
FIG. 2 is a schematic view showing circulation of a cleaning agent through a feed line after introduction in accordance with the chemical cleaning method of the present invention.
Figure 3:
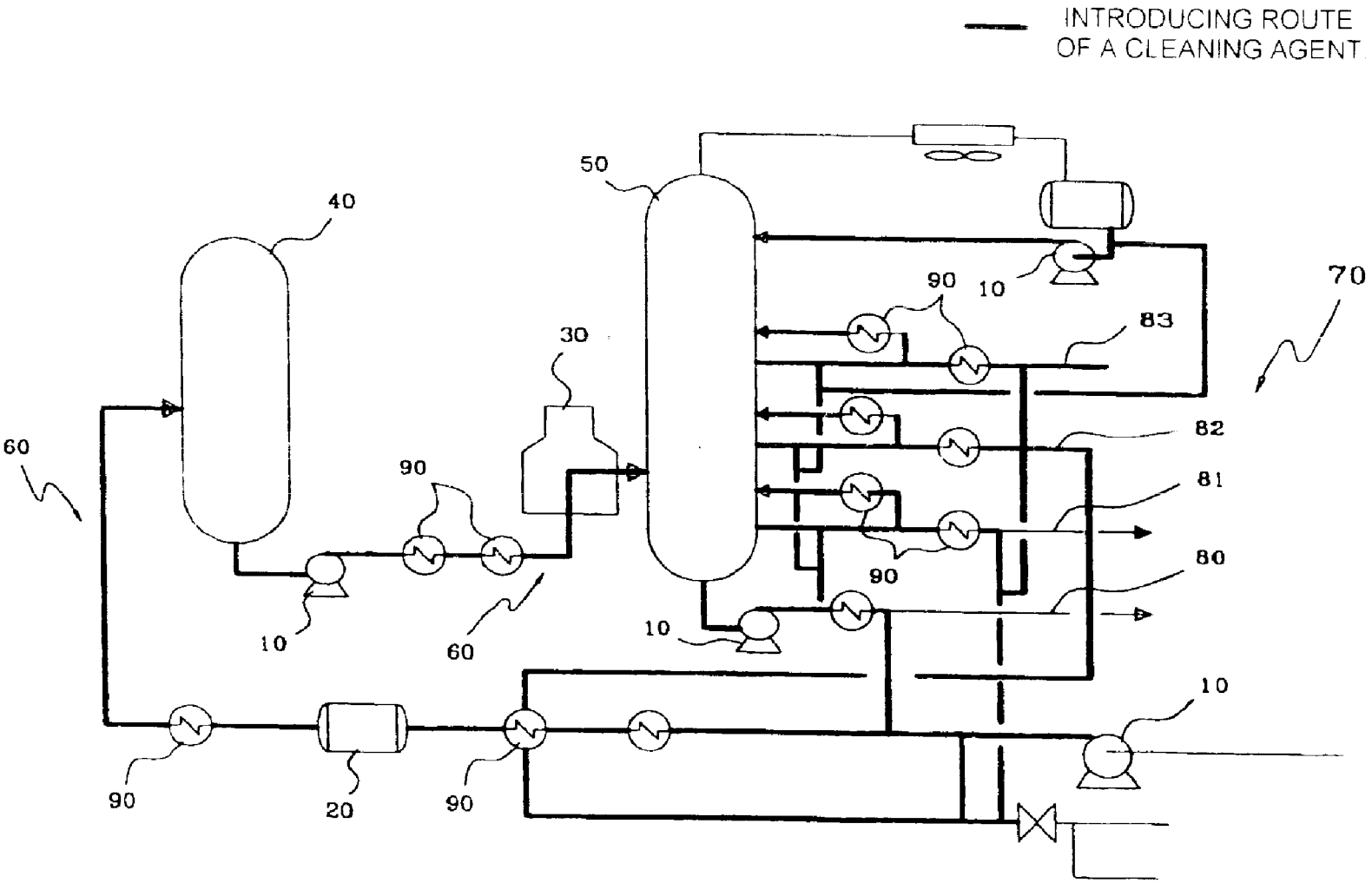
FIG. 3 is a schematic view showing the circulation of the cleaning agent through the [entire] process lines including a side stream line after circulation through a feed line in FIG. 2.

FIGS. 1 to 3, show the steps of removing fouling formed within oil refining process lines. As shown in the Figures, the oil refining process lines are subject largely to two streams: a main stream and a side stream. The main stream usually consists of a feed line 60 and a residual crude line 80, while the side stream 70 comprises an HGO line 81, a LCO line 82 and a kerosene line 83. The driving force for moving crude oil and refined oils may be provided by pumps 10, which are installed on the lines. Heat exchangers 90 are also present to exchange heat from the oils. Salt is removed from crude oil introduced into the feed line 60 by the action of a desalter 20 and passed to an atmospheric front column 40. Crude oil is then transferred to an atmospheric distillation tower 50 which is connected to the side stream lines. Prior to entering the atmospheric distillation tower 50, the crude oil passes through a heater 30.

A description will now be given of the cleaning process of the present invention in conjunction with the accompanying drawings.

First Step

Under a feed-cut state a cleaning agent is guided into a feed line 60 by an inlet pipe and allowed to fill the entire feed line 60, as shown in FIG. 1, while the crude oil already present in the line is discharged through a residue crude (RC) line 80. At this time, the valves for all lines except the feed line 60 and the RC line 80 are closed while the preexisting crude oil is transferred to a crude oil tank (not shown) for re-treatment.

The cleaning agent in the present invention is any fouling removal agent well known in the art, but most preferably is a cleaning agent comprising 2 to 20 vol. % of a cleaning composition consisting of 0.01 to 1 wt % of a C8 aromatic compound, 75 to 85 wt % of a C9 aromatic compound and 14 to 24 wt % of a C10 aromatic compound, and 80 to 98 vol % of an LCO or an LGO. LCO is usually produced as an intermediate distillate in the fluid catalytic cracking process, and is used as a blending material for bunker-C oil or diesel. LGO is produced in a crude distillation unit (CDU), and is used as a diesel or blending material for bunker-C oil or kerosene. Particular combinations of the cleaning composition and LCO or LGO are similar in solvent power to pure toluene which is an excellent solvent.

The C8 aromatic compound useful in the present invention is o-xylene. Also available is the C9 aromatic compound selected from the group consisting of 1,2,4-trimethyl benzene, 1-methyl-3-ethyl benzene, and a mixture thereof. The C10 compound is selected from the group consisting of 1-methyl-3-n-propylbenzene, 1,2-dimethyl-4-ethylbenzene, 1,2,3,5-tetramethylbenzene, and mixtures thereof.

Second Step

After introducing the cleaning agent into feed line 60, RC line 80 is closed and the cleaning agent is allowed to circulate through feed line 60, as shown in FIG. 2. Next, the cleaning agent is heated by use of a heat source present in the oil refining process to create thermal circulation while feed line 60 is being cleaned. Feed line 60 is cleaned first—with the aim of maximizing the cleaning effect by using a fresher cleaning agent to dislodge fouling formed in the main stream. Mainstream fouling occurs to a greater extent than in the side stream 70.

During the thermal circulation of the cleaning agent, fouling is dislodged. Without limitation as to theory, it is believed organic heavy hydrocarbons intercalated between inorganic materials are dissolved in the LCO ingredient of the cleaning agent which weaken the cohesion between organic materials and inorganic materials and other components comprising the fouling. This is called a softening step and is followed by detachment of the fouling. The fouling is detached due to the weakened cohesion between the components thereof. Once having been used, the cleaning agent can be re-treated, together with crude oil, in CDU or reused as a bunker-C oil blending material, so that environmental pollution resulting from the treatment of waste oil is not produced.

The cleaning process is preferably conducted at a temperature of 100 to 250° C. At higher temperatures, molecules generally move faster, with higher kinetic energy, and collide more frequently with each other to produce higher reaction and solvation rates. Without limitation as to theory it is believed the solvation or reaction rates of the cleaning agent can be increased by raising the temperature, so that the cleaning period may be reduced. Due to limitations resulting from operational temperature control allowances and the initial distilling point for LCO, the upper temperature limit to obtain the cleaning effect is 250° C. At less than 100° C., only a very insignificant cleaning effect is obtained.

Third Step

Valves are opened to allow the cleaning agent to flow into the side stream 70. The cleaning agent is introduced into HGO line 81, LGO line 82, and kero line 83, in order. The cleaning agent is then continuously circulated while L-values (infrared ray transmittance of samples) are measured. When the cleaning is completed, the cleaning agent is cooled and discharged. Afterwards, crude oil is introduced again and oil refining processes may be conducted.

The L-values are measured with a near-infrared analyzer to monitor the extent of cleaning and to determine when cleaning is satisfactorily complete. When a light emitted from the optical instrument passes through the cleaning agent, the light transmittance of the cleaning agent is changed according to its turbidity or absorption. In the optical instrument, the L-values are represented as digital values, indicating that a higher value is read as a whiter cleaning agent and a lower value as a darker cleaning agent.

Figure 4:
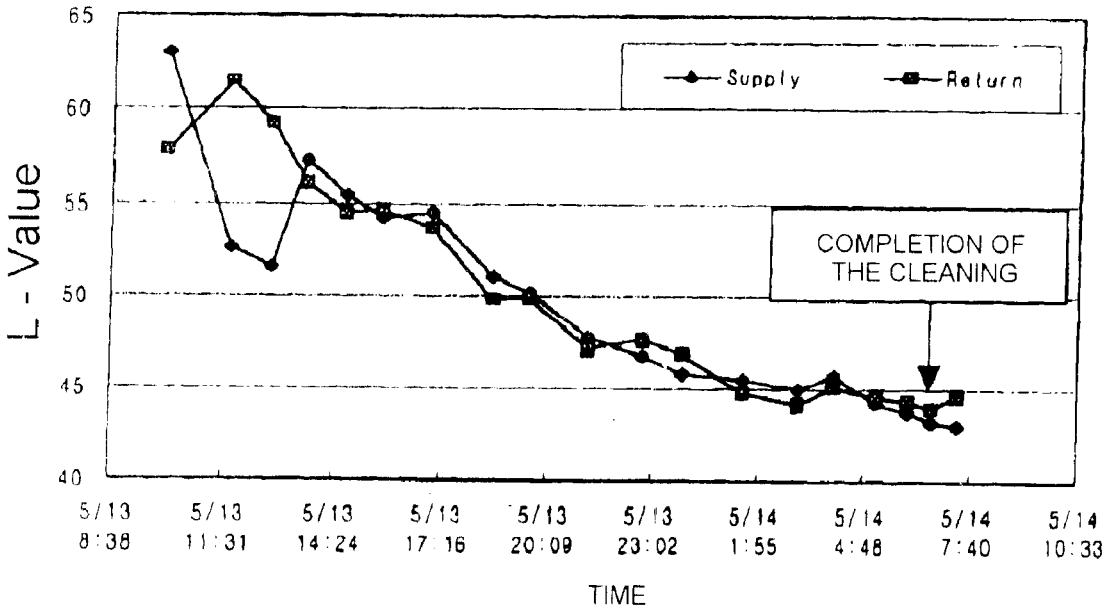
FIG. 4 is a graph in which the L-values of cleaning agent samples are plotted as a function of the cleaning progress (cleaning time) of the present invention.

As shown in FIG. 4, L-values may be used to monitor cleaning progress. As FIG. 4 shows transmittance and thus, the L-value is decreased as the organic heavy hydrocarbons present in the fouling are dissolved in the cleaning agent. When the cleaning agent is saturated or when there are no hydrocarbons to be dissolved, the L-value remains essentially unchanged. This indicates the completion of the cleaning.

In the case of periodic maintenance, the cleaning agent is discharged, after which LGO is introduced to remove the smell of LCO. This is followed by steam purging.

A better understanding of the present invention may be obtained in light of the following examples which are set forth to illustrate, but are not to be construed to limit, the present invention.

EXAMPLE 1

During the running of an oil refining process in a feed-cut state, a cleaning agent comprising 10 vol % of the composition indicated in Table 1, below, and 90 vol % of LCO was introduced into the process line while it was in an on-line state as shown in FIG. 1. The cleaning agent was circulated with a sustained temperature of 250° C. The cleaning was completed when no changes were detected in the L-value of the cleaning agent by use of a near IR analyzer.

TABLE 1

| | Composition Properties | | |
|---|---|---|---|
| API | 28.8 | Distillation (° C.) | |
| C8 Aromatic Cpd. | 0.05 Wt % | Initial Distilling Point | 163.0 |
| C9 Aromatic Cpd. | 80.78 wt % | 10% | 164.4 |
| CIO Aromatic Cpd. | 19.17 wt % | 20% | 164.9 |
| | | 50% | 166.2 |
| | | 90% | 176.7 |
| | | 95% | 199.0 |
| | | Final Distilling Point | 220.8 |

In Table 1, o-xylene was selected as the C8 aromatic compound, a mixture of 1,2,4-trimethylbenzene and 1-methyl-3-ethylbenzene as the C9 aromatic compound, and 1-methyl-3-n-propylbenzene as the C10 aromatic compound. The initial distilling point, which represents the initial boiling point of the oil, means the temperature of the gas phase when a condensate is initially formed in a rear condenser while 100 $cm^3$ of oil is distilled at a constant rate of 5 cc per min. The final distilling point means the final boiling point of the oil.

EXAMPLE 2

The same procedure as in Example 1 was repeated except that LCO was used instead of the cleaning agent. The results are given in Table 2, below.

EXAMPLE 3

Figure 5:
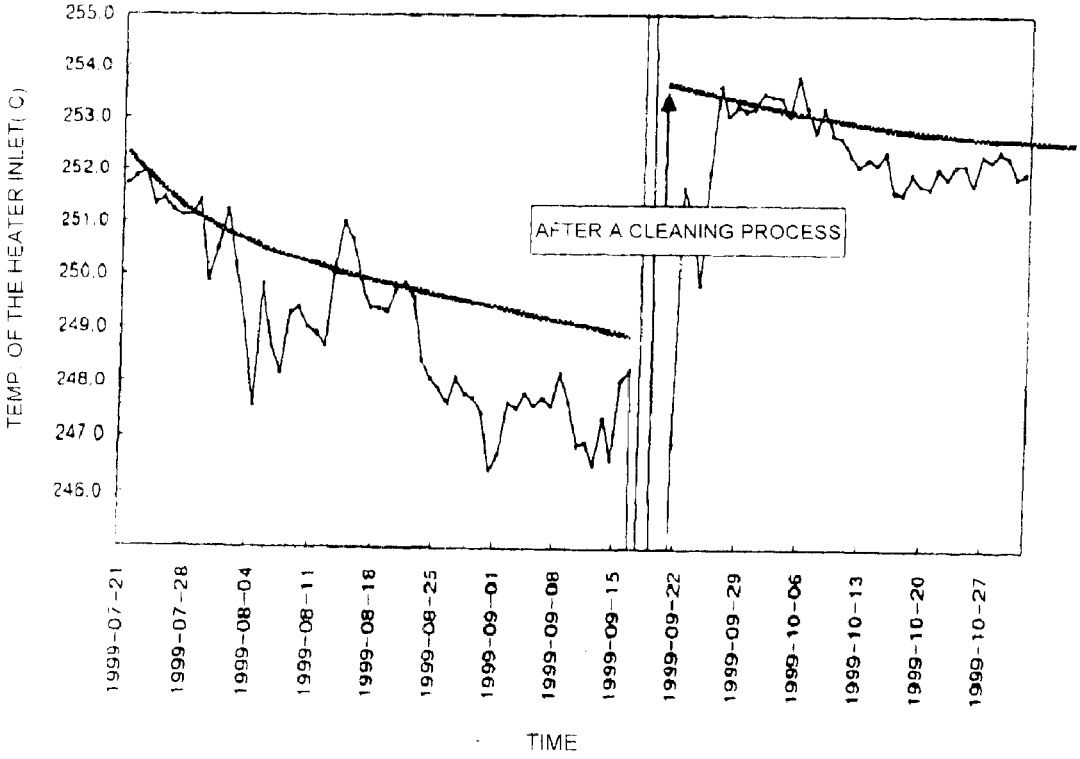
FIG. 5 is a graph in which the temperature of the heater inlet is plotted as a function of the time period of the process operation.

To specify the effect of the present invention, the temperature of the heater inlet was monitored with regard to the time period of the process operation. The results are shown in FIG. 5 and given in Table 2, below. As is apparent from FIG. 5 and Table 2, the temperature of the heater inlet is decreased with the passage of time because of fouling within individual process lines and heat exchangers, but after conducting the cleaning process of the present invention, the temperature has recovered to almost the same level as the SOR, indicating that the cleaning method is highly efficient. In addition, as shown in Table 2, the cleaning method of the present invention can guarantee a pronounced cleaning effect even if conventional cleaning agents are applied.

TABLE 2

| | Temp. of Heater Inlet (° C.) | | | | |
|---|---|---|---|---|---|
| Nos of Example | SOR | Before Cleaning | After Cleaning | Cleaning Efficiency (%) | Applied Process |
| 1 | 254 | 246.5 | 253.5 (+7) | 93.3 | SK HCDU |
| 2 | 257 | 248 | 254 | 67 | SK BCDU |

As described herein, the cleaning method of the present invention can effectively return the thermal efficiency in oil refining processes or petrochemical processes to optimal levels within a short period of time by removing fouling formed within process lines and heat exchangers. As a result, energy consumption can be reduced because a decreased amount of fuel is needed to operate the cleaned heat exchangers relative to fouled heat exchangers. In addition, the processing capacity of the heater is returned to the SOR level because the load imposed on the heater is decreased as the temperature of the heater inlet is increased. Further, the method of the present invention requires a shorter cleaning period and thus, secures a longer operating period than conventional mechanical methods. Moreover, the method of the present invention can dislodge fouling without opening heat exchangers or other equipment. This prevents the release of VOCs and prevents pollution of the environment. Lastly, the present invention is economically favorable as it extends the time between periodic maintenances.

The present invention has been described in an illustrative manner, and it is to be understood that the terminology used is intended to be in the nature of description rather than of limitation. Many modifications and variations of the present invention are possible in light of the above teachings. Therefore, it is to be understood that within the scope of the appended claims, the invention may be practiced otherwise than as specifically described.

What is claimed is:

1. A chemical cleaning process for removing fouling from process lines of oil refining or petrochemical plants, in which the process lines are in an on-line state, comprising:

introducing a cleaning agent into the process lines with discharging of crude oil already filled in the lines, said cleaning agent comprising 2 to 20 vol. % of a cleaning composition comprising 0.01 to 1 wt % of a C8 aromatic compound, 75 to 85 wt % of a C9 aromatic compound and 14 to 24 wt % of a C10 aromatic compound, and 80 to 98 vol % of a light cycle oil (LCO) or a light gas oil (LGO);

circulating the cleaning agent through the process lines and increasing the temperature of the cleaning agent by use of a heating source to remove fouling in the process lines; and monitoring the light transmittance of the circulating cleaning agent with the aid of a near-infrared analyzer to determine whether the cleaning of the process lines is completed.

2. The chemical cleaning process as set forth in claim 1, wherein the C8 aromatic compound is o-xylene, the C9 aromatic compound is selected from the group consisting of 1,2,4-trimethylbenzene, 1-methyl-3-ethylbenzene, and a mixture thereof, and the C10 aromatic compound is selected from the group consisting of 1-methyl-3-n-propylbenzene, 1,2-dimethyl-4-ethylbenzene, 1,2,3,5-tetramethlybenzen, and mixtures thereof.

3. The chemical cleaning process as set forth in claim 1, wherein the process is applied upon periodic maintenance of during operation with a feed-cut condition, immediately after which the oil refining or petrochemical processes are conducted.

4. The chemical cleaning process as set forth in claim 1, wherein the cleaning agent is heated to a temperature of 100 to 250° C.

5. The chemical cleaning process as set forth in claim 1, wherein the circulating step is ceased when the transmittance of the circulating cleaning agent remains unchanged.

6. The chemical cleaning process as set forth in claim 1, wherein the process lines comprise a crude oil-feeding line, a residue crude line, and a side stream.

* * * * *